US011492683B2

(12) United States Patent
Kruger

(10) Patent No.: US 11,492,683 B2
(45) Date of Patent: Nov. 8, 2022

(54) DENSITY-OPTIMIZED MOLYBDENUM ALLOY

(71) Applicant: OTTO-VON-GUERICKE-UNIVERSITAT MAGDEBURG, Magdeburg (DE)

(72) Inventor: Manja Kruger, Magdeburg (DE)

(73) Assignee: OTTO-VON-GUERICKE-UNIVERSITAT MAGDEBURG, Magdeburg (DE)

( * ) Notice: Subject to any disclaimer, the term of this patent is extended or adjusted under 35 U.S.C. 154(b) by 0 days.

(21) Appl. No.: 17/059,350

(22) PCT Filed: Jun. 4, 2019

(86) PCT No.: PCT/EP2019/064475

§ 371 (c)(1),
(2) Date: Nov. 27, 2020

(87) PCT Pub. No.: WO2019/234016

PCT Pub. Date: Dec. 12, 2019

(65) Prior Publication Data

US 2021/0238717 A1 Aug. 5, 2021

(30) Foreign Application Priority Data

Jun. 5, 2018 (DE) ..... 10 2018 113 340.5

(51) Int. Cl.
*C22C 27/04* (2006.01)
*F01D 25/00* (2006.01)

(52) U.S. Cl.
CPC ..... *C22C 27/04* (2013.01); *F01D 25/005* (2013.01); *F05D 2300/131* (2013.01)

(58) Field of Classification Search
None
See application file for complete search history.

(56) References Cited

U.S. PATENT DOCUMENTS 5,595,616 A * 1/1997 Berczik ..... C22C 32/0047 148/538
5,693,156 A 12/1997 Berczik
(Continued)

FOREIGN PATENT DOCUMENTS

DE 1155609 10/1963
DE 2534379 A1 2/1976
(Continued)

OTHER PUBLICATIONS

Mendiratta et al., Effect of Alloying Additions on the Phase Equilibria and Oxidation in the Mo—Si—B System, Materials and Manufacturing Directorate Air Force Research Laboratory Air Force Materiel Command, Accession No. ADA394736, pp. 1-38. (Year: 2001).*

(Continued)

*Primary Examiner* — Elizabeth Collister
(74) *Attorney, Agent, or Firm* — Barlow, Josephs & Holmes, Ltd.; Stephen J. Holmes

(57) ABSTRACT

The present invention relates to a density-optimized and high temperature-resistant alloy based on molybdenum-silicon-boron, wherein vanadium is added to the base alloy in order to reduce the density.

16 Claims, 2 Drawing Sheets

[MK1]

(56) References Cited

U.S. PATENT DOCUMENTS

Figure 1:
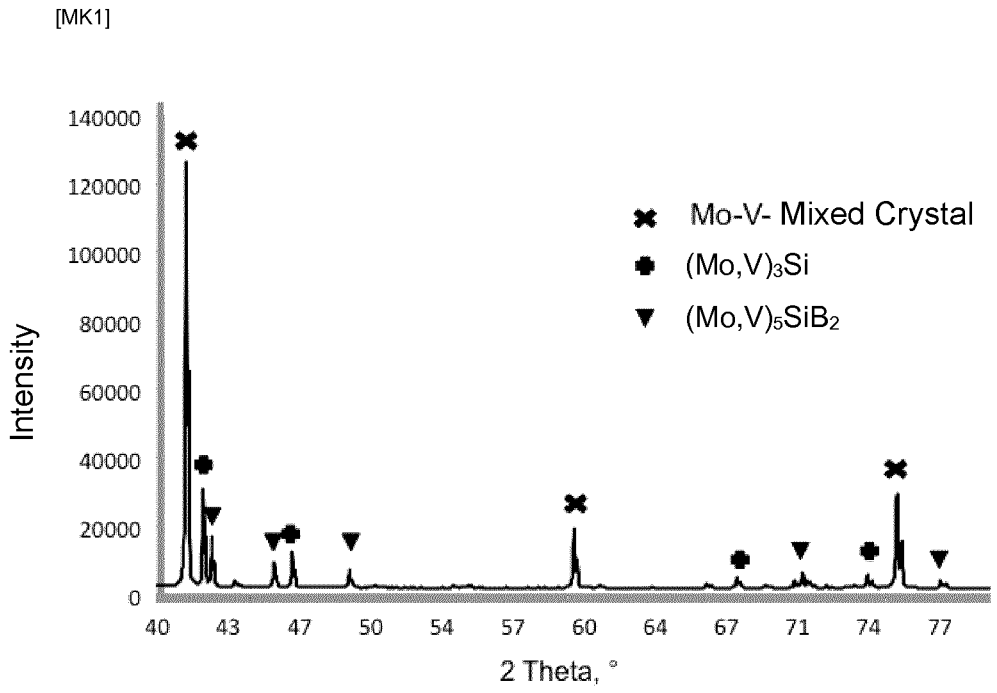

| | | | | |
|---|---|---|---|---|
| 5,865,909 | A * | 2/1999 | Meyer | F01D 5/28 148/423 |
| 6,652,674 | B1 * | 11/2003 | Woodard | C22C 27/04 148/423 |
| 7,005,191 | B2 | 2/2006 | Perepezko et al. | |
| 2002/0119340 | A1 | 8/2002 | Zhao et al. | |
| 2006/0169369 | A1 * | 8/2006 | Jehanno | C22C 37/04 148/423 |
| 2006/0285990 | A1 * | 12/2006 | Jehanno | C22C 1/045 419/29 |
| 2014/0141281 | A1 | 5/2014 | Kadokura et al. | |
| 2015/0056408 | A1 * | 2/2015 | Kadokura | B21C 25/025 428/141 |
| 2015/0082945 | A1 | 3/2015 | Myers et al. | |
| 2016/0060734 | A1 | 3/2016 | Smarsly et al. | |

FOREIGN PATENT DOCUMENTS

| | | | |
|---|---|---|---|
| DE | 69620998 | T2 | 6/2002 |
| DE | 102018113340 | A1 | 12/2019 |
| DE | 102018113340 | B4 | 12/2019 |
| EP | 0804627 | B1 | 5/2002 |
| WO | 2005028692 | A1 | 3/2005 |
| WO | 2016188696 | A1 | 12/2016 |
| WO | 2017032825 | A1 | 3/2017 |

OTHER PUBLICATIONS

Becker et al.; Density Reduction of Mo—Si—B Alloys by Vanadium Alloying, JOM, vol. 70, No. 11, 2018, pp. 2574-2581 (Year: 2018).*

PCT Notification Concerning Transmittal of International Preliminary Report on Patentability (Chapter 1 of the Patent Cooperation Treaty), Form PCT/IB/326, dated Dec. 17, 2020.

PCT International Preliminary Report on Patentability (Chapter I of the Patent Cooperation Treaty) Form PCT/IB/373, dated Dec. 8, 2020.

PCT Notification of Transmittal of Translation of the International Preliminary Report on Patentability (Chapter I or Chapter II), Form PCT/IB/338, dated Dec. 17, 2020.

PCT International Preliminary Report on Patentability (Chapter I of the Patent Cooperation Treaty) and Translated Written Opinion Forms 373 and 237, dated Dec. 8, 2020.

* cited by examiner

DENSITY-OPTIMIZED MOLYBDENUM ALLOY

The present invention relates to a density-optimized and high-temperature-resistant alloy based on molybdenum-silicon-boron (Mo—Si—B), a method for its production, and its use as a structural material.

The ternary Mo—Si—B alloy system exhibits not only a very high melting temperature (beyond 2000° C.), which makes possible its use at temperatures markedly above 1000° C., but is further characterized by a good oxidation resistance, an outstanding creep resistance, and a satisfactory ductile-brittle transition temperature and fracture toughness.

Based on these properties, the ternary Mo—Si—B alloy system is suitable, in particular, as a structural material for the production of structural components that are operated at very high temperatures, such as, for example, turbine blades and disks in gas turbines, for structural components in aviation technology and aerospace technology that are subject to high stress, but also for tools used in forming technology.

Of special advantage for high-temperature use is the very good oxidation resistance of this alloy system, provided that the silicide proportion is greater than 50%. Protective measures for preventing oxidation, such as, for example, the use of protective gas or the application of protective layers, can accordingly be dispensed with in the case of materials produced by powder metallurgy or in the case of other, very fine-grained materials produced with a particle size of less than 10 μm and a homogeneous phase distribution.

Pure molybdenum, as a refractory metal, has a melting point of 2623° C. and is thus suitable, in principle, for high-temperature applications. However, a problem is its low oxidation resistance even at temperatures above 600° C.

Through the alloying of silicon and boron to molybdenum and the formation of silicides associated therewith, a significant increase in the oxidation resistance has been achieved. A ternary oxidation-resistant Mo—Si—B alloy of this kind is described in EP 0 804 627 B1, for example. At temperatures above 540° C., this ternary alloy system forms a boron-silicate layer, which prevents any further penetration of oxygen into the solid or into the structural component.

DE 25 34 379 A1 relates to a Mo—Si—B alloy, which, among other things, can also contain vanadium. However, what is involved here is an amorphous alloy that is characterized by a high thermal stability, that is, which is stable even at high temperatures and does not begin to crystallize.

DE 11 55 609 A likewise describes Mo alloys, which, as essential component, contain at least one metal boride selected from chromium boride, titanium boride, and zirconium boride, and which can comprise Si, B, as well as V. None of the numerous explicitly described examples also contain V in addition to Mo. The exclusive aim in this case is to increase the oxidation resistance and the strength, but not to improve the toughness, as is desired in accordance with the invention.

Described in WO 2005/028692 A2 is a Mo—Si—B alloy that comprises Mo silicide and Mo—B silicide as essential components. Optionally, a Mo mixed crystal can also be present and can contain further elements that form a mixed crystal with Mo, wherein, among other things, vanadium is mentioned. However, in this case, the additional element or elements are present exclusively in the mixed crystal, but not in the silicides.

According to US 2016/0060734 A1, the density of a ternary Mo—Si—B alloy can be reduced by partially exchanging the heavy metal Mo for the markedly lighter metal Ti. It is noted, however, that the partial replacement of Mo by Ti has a detrimental effect on the oxidation resistance. In order to compensate for this, it is necessary to add additional elements, such as iron and/or yttrium.

In regard to the aforementioned outstanding property profile, this ternary Mo—Si—B alloy system would be a highly promising candidate as a structural material at high temperatures also for rotating or flying applications, such as, for example, as a turbine material.

A drawback for applications of this kind as well as for other applications is, in this case, the high density, which typically lies between 8.5 and 9.5 g/cm$^3$. For example, the alloy Mo-9Si-8B has a density of 9.5 g/cm$^3$.

The object of the present invention, therefore, was to provide an alloy system based on Mo—Si—B that has a lower density than that of the known Mo—Si—B alloy systems and accordingly can be utilized advantageously as a structural material for rotating or flying applications, in particular also in aviation technology and aerospace technology, as a turbine material, for example. Furthermore, the alloy system should retain the advantages of the ternary alloy system Mo—Si—B, in particular in regard to oxidation resistance.

This object is achieved by an alloy system containing 5 to 25 at % silicon (Si), 0.5 to 25 at % boron (B), 3 to 50 at % vanadium (V), as well as the remainder of molybdenum, wherein the molybdenum alloy has a molybdenum-vanadium mixed crystal matrix and at least one silicide phase distributed therein, and the density of the molybdenum alloy is less than 8 g/cm$^3$.

In accordance with a preferred embodiment, the molybdenum alloy has a vanadium content of 10 to 50 at %, as well as at least one silicide phase selected from $(Mo,V)_3Si$, $(Mo,V)_5SiB_2$, and $(Mo,V)_5Si_3$.

Preferably, the content of Mo is greater than 10 at %, in particular at least 20 at % and greater. Especially preferred is a content of Mo of at least 40 at % and greater. Preferred content ranges are 8-15 at % for Si, 7-20 at % for B, and 10-40 at % for V.

Preferably, the alloy system according to the invention has a silicide phase proportion of at least 30% and, in particular, at least 50%.

With a melting point of 1910° C. and thus less than 2000° C., vanadium belongs to the so-called extended refractory metals, but has a markedly lower density of 6.11 g/cm$^3$ at 293.15 K than molybdenum with 10.28 g/cm$^3$. A further advantage of vanadium is that it has an atomic radius (134 pm) similar to that of molybdenum (145 pm) and the same crystal structure, namely, body-centered cubic. This results in a good miscibility and exchangeability of these two elements in the crystal lattice and thus a good alloyability of the two elements. In addition, vanadium exhibits a high ductility, so that its addition does not have a detrimental effect on the toughness of the ternary Mo—Si—B alloy.

The alloys according to the invention with addition of vanadium have, in particular, a density of less than 8 g/cm$^3$ at 293.15 K.

It has been found that the alloyed vanadium dissolves into the respective Mo mixed crystal and silicide phases, but not does change the structural features of the known phases in Mo—Si—B alloys.

The ternary Mo—Si—B system has a Mo mixed crystal matrix, which, as such, has a good toughness. Boron occupies intermediate lattice positions and silicon occupies regular lattice positions in the Mo phase.

In addition, silicide phases can already form during the prealloying, for example in the case of very long and high-energy alloying processes or in the case of powder atomization. Silicide phases form at the latest during the compacting of the powder and/or during thermal treatment. These phases, in particular $Mo_3Si$ (A15) and $Mo_5SiB_2$ (T2), impart to the system a high strength, but decrease the toughness due to their brittleness. With increasing concentration of silicon and boron, the proportion of the silicide phases increases and, when a critical proportion (approximately 50% in the case of production by means of the mechanical alloying process) is exceeded, the silicide phases can form the matrix phase in the structure. It is expected that, as a result of this, there is, in addition to a decrease in the toughness, also a shift in the brittle-ductile transition temperature toward high temperatures. In order to avert these drawbacks, therefore, it is aimed at producing alloys with Mo mixed crystal phase as matrix phase.

The addition of V does not lead to a decline in the toughness of Mo—Si—B alloys, but rather to the stabilization of the Mo mixed crystal phase and, with a slightly increased mixed crystal proportion, to an improvement in the toughness of the overall system.

Furthermore, the substitution of V atoms in the Mo mixed crystal lattice leads to a further improvement in the strength.

As a result, it can be stated that the addition of vanadium to the ternary Mo—Si—B alloy system does not only lead to a decrease in the density, but, at the same time, to an improvement in the strength while retaining the toughness. In addition, as a result of the addition of V, the alloy system according to the invention has a structure in which the silicide phases are distributed in a Mo mixed crystal matrix even for silicide phase proportions of greater than 50%.

In accordance with a preferred embodiment, titanium (Ti) can be added to the Mo—Si—B—V base alloy in an amount of 0.5-30 at %.

It was found that an addition of 0.5 to 10 at % leads to a stabilization of the mixed crystal $(Mo,V)_3Si$—$(Mo,V)_5SiB_2$ structure and an addition of 10 to 30 at % promotes the production of a 4-phase alloy mixed crystal $(Mo,V)_3Si$—$(Mo,V)_5SiB_2$—$(Mo,V)_5Si_3$. In the case of $(Mo,V)_5Si_3$, what is involved is the T1 phase. Moreover, the addition of Ti, which has a density of only 4.51 g/cm$^3$, contributes to a further decrease in the density.

As needed, the base alloy according to the invention can contain one additional alloy element or a plurality of additional alloy elements selected from the group composed of Al, Fe, Zr, Mg, Li, Cr, Mn, Co, Ni, Cu, Zn, Ge, Ga, Y, Nb, Cd, Ca, and La, each in a content of 0.01 at % to 15 at %, preferably up to 10 at %, and/or one alloy element or a plurality of alloy elements selected from the group composed of Hf, Pb, Bi, Ru, Rh, Pd, Ag, Au, Ta, W, Re, Os, Ir, and Pt, each in a content of 0.01 at % up to preferably at most 5 at %. In the case of the last group, what is involved are heavy elements with a density of greater than 9 g/cm3, which, in order to avoid an increase in the density, should be added in as small an amount as possible.

The aforementioned additional alloy elements can also be added in the form of their oxides, nitrides, and/or carbides and as complex phases (e.g., oxynitrides) in concentrations of up to 15 vol % of the alloy.

In terms of manufacturing technology, the alloys according to the invention can further contain interstitially soluble elements such as oxygen, nitrogen, and hydrogen. What are involved in this case are unavoidable impurities, which cannot always be kept completely out of the process. However, these impurities lie in the ppm range of typically less than 100 ppm.

What is involved in the case of the alloys according to the invention are non-eutectic alloys, but also near-eutectic and eutectic alloys. Non-eutectic alloys are alloys that do not correspond to eutectic stoichiometry. In contrast, near-eutectic alloys are alloys that are situated in the vicinity of the eutectic in terms of their composition.

The production of non-eutectic alloys according to the invention takes place advantageously by means of powder metallurgical process techniques, in which powder mixtures, which are composed of the corresponding alloy components, are treated by mechanical alloying, whereby both elemental powder and also prealloyed powder can be used. For mechanical alloying, it is possible to utilize various high-energy mills, such as, for example, attritors, common ball mills, vibration mills, and planetary ball mills. In this process, the metal powder undergoes intensive mechanical treatment and is homogenized all the way to the atomic level.

Alternatively, the prealloying can also take place by means of an atomization process under protective gas.

Subsequently, the mechanically alloyed powder can be compacted by means of FAST (field-assisted sintering technology). A suitable FAST process takes place, for example, under vacuum at a pressure of 50 MPa and a holding time of 15 minutes at 1600° C., during which heating and cooling occur at 100 K/min. Alternatively to this, the powder can also be compacted by means of cold isostatic pressing, sintering at 1600° C., for example, and hot isostatic pressing (HIP) at 1500° C. and 200 MPa. Preferred, however, is the FAST process, because the process times during sintering are substantially shortened in comparison to hot pressing.

In addition, it is possible, even in the case of larger structural components, to achieve homogeneous material properties. It is also possible with FAST to obtain a higher strength and hardness, which is expressed here as microhardness, because, due to the markedly shorter process times, the grain growth during the process is suppressed. In contrast to coarser grains, fine grains in the structure result in a better strength.

Alternatively to the powder-metallurgical process, the density-optimized alloy according to the invention can be produced by means of an additive manufacturing method, such as, for example, selective laser melting (SLM) or laser metal deposition (LMD). In this case, the processing takes place on the basis of mechanically alloyed or atomized and thus prealloyed powders, which, due to the addition of V (and, if need be, Ti or other alloy elements), have a lower melting point in comparison to pure ternary Mo—Si—B alloys, and thus can be processed more easily by means of methods of this kind. An advantage of the additive manufacturing method is that it is possible to obtain structural components of near final structure in a cost-, time-, and material-efficient manner. Additive manufacturing methods of this kind are known as such and are described in WO 2016/188696 A1, for example.

Near-eutectic and eutectic alloys can be processed especially well by way of additive methods, because it is possible to produce especially fine-grained structures having good mechanical strength. Such alloys lie in a composition range of Mo-(7 . . . 19)Si-(6 . . . 10)B-(5 . . . 15)V or Mo-(7 . . . 19)Si-(6 . . . 10)B-(5 . . . 15)V-(5 . . . 18)Ti. Beyond this, these alloys are also suitable for other melt metallurgical methods, including also the directional solidification in the known Bridgman method.

Figure 2:
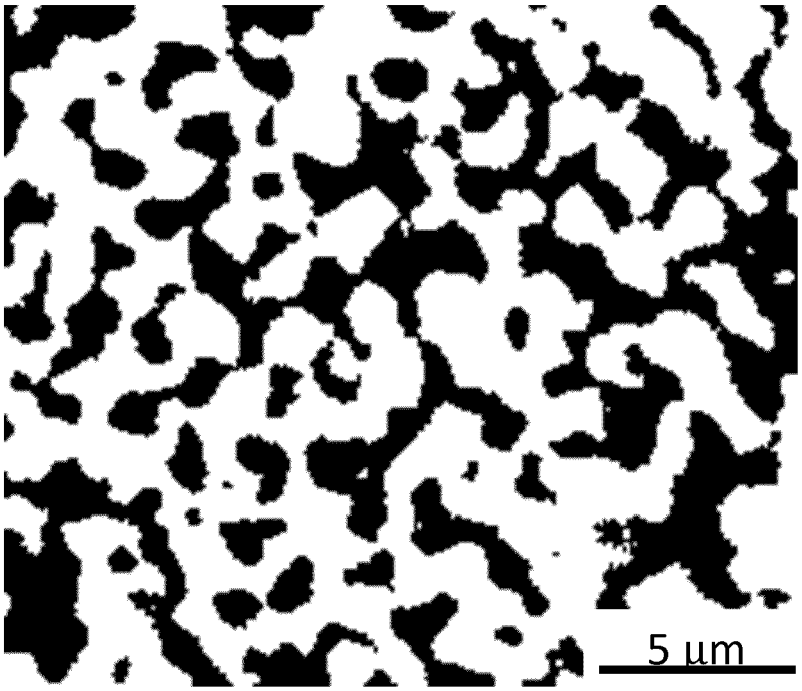
Figure 3:
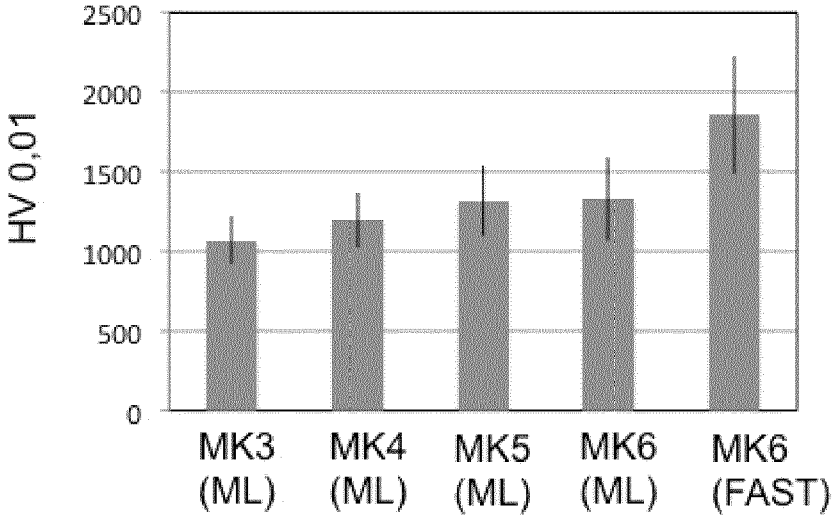

The alloy system according to the invention is characterized in detail below on the basis of examples and figures, in which FIG. 1 shows an x-ray diffractogram of the alloy specimen MK6-FAST (Mo-40V-9Si-8B);

FIG. 2 shows the microstructure of the alloy specimen MK6-FAST according to FIG. 1 after compaction by means of the FAST method, depicted as a binary image; and FIG. 3 shows the results of the microhardness test taking into consideration the standard deviation of the alloy specimens in accordance with the examples.

A) Specimen Preparation

1. Mechanical Alloying

Alloys with 10, 20, 30, and 40 at % vanadium were prepared. The atomic contents of silicon (9 at %) and boron (8 at %) remain the same for all alloy systems. 30 g of each alloy system were prepared. For this purpose, the individual alloy components were weighed out under argon protective gas atmosphere and placed in a grinding vessel. The obtained powder mixtures were ground in a planetary ball mill of the company Retsch GmbH (Model PM 4000) using the following parameters:

| | |
|---|---|
| Speed | 200 rpm |
| Temperature | 20° C. (293.15 K) |
| Ball/powder ratio | 14:1 (100 balls) |
| Grinding time | 30 hours |

The obtained alloys were given the following designations:

| Designation | Alloy composition |
|---|---|
| MK3 | Mo—10V—9Si—8B |
| MK4 | Mo—20V—9Si—8B |
| MK5 | Mo—30V—9Si—8B |
| MK6 | Mo—40V—9Si—8B |

2. Heat Treatment

The alloys obtained in accordance with 1. were heat-treated. The specimens were each placed in ceramic crucibles and annealed under argon protective gas over the entire period of heat treatment.

For this purpose, approximately 10 g of each of the alloys present in the initial state were poured out and subjected to heat treatment at 1300° C. for 5 hours in a kiln of the HTM Retz GmbH Losic model.

The specimens obtained were given the following designations:

MK3-WB, MK4-WB, MK5-WB, and MK6-WB

3. Preparation of an Alloy Specimen by Means of FAST

The specimen MK6-WB was compacted by means of FAST. For this purpose, the specimen was placed under vacuum at a pressure of 50 MPa and a holding time of 10 minutes at 1100° C. and 15 minutes at 1600° C., whereby it was heated and cooled at 100 K/min.

The obtained specimen was given the designation MK6-FAST.

B) Structure Investigation

1. X-ray diffractometry (XRD)

The structure investigation of the specimens MK3-WB, MK4-WB, MK5-WB, MK6-WB, and MK6-FAST, ground to powder, was carried out by means of x-ray diffraction analysis using an x-ray diffractometer system PANalytical X'pert pro:

radiation: Cu-K21,21,5406
voltage: 40 kV
current: 30 mA
detector X' Celerator RTMS
filter: Ni filter
measuring range: $20° \leq 2\Theta \leq 158.95°$
step width: 0.0167°
measuring time 330.2 s (per step width).

In all five specimens, the phases Mo—V mixed crystal, $(Mo,V)_3Si$, and $(Mo, V)_5 SiB_2$ were detected.

The result of the analysis for MK6-FAST is depicted in FIG. 1.

2. Structure Investigation and Density Determination

The microstructure and the morphology of the powder particles were analyzed using a scanning electron microscope ESEM (SEM) XL30 of the Philips company. The depiction of the phase contrasts occurred by means of BSE contrast. The obtained phases were assigned by means of EDX analysis.

For the specimen preparation, small amounts of the specimen powder were embedded cold in epoxy resin as follows and then wet-ground using SiC sandpaper with grains of 800 and 1200 and polished with a diamond suspension.

For the SEM investigation, the specimens were sputtered with a thin layer of gold prior to being embedded.

The structure of the alloy MK6-FAST is depicted in binarized form in FIG. 2. In this case, the Mo mixed crystal phase is white and the two silicide phases are black.

The density of MK6-FAST was determined by means of the Archimedes principle to be 7.8 g/cm$^3$.

C) Analysis

1. SEM/EDX Analysis

The EDX analysis confirmed the results of the XRD measurement. In the structure of all specimens, the silicide phases $(Mo,V)_3Si$ and $(Mo,V)_5SiB_2$ have formed in addition to the Mo mixed crystal. A higher proportion of vanadium was thereby found in the silicide phases than in the mixed crystal matrix.

The analysis of MK6-FAST revealed that, in comparison to the heat-treated specimens, it has the highest proportion of silicide phases in the structure.

Summarized in the following table are the percent proportions (at %) of the silicide phases in the individual specimens.

| Sample | Silicide phases (at %) |
|---|---|
| MK3-WB | 46.0 |
| MK4-WB | 47.8 |
| MK5-WB | 51.1 |
| MK6-WB | 52.6 |
| MK6-FAST | 55.4 |

2. Microhardness Test

The microhardness of the mechanically alloyed (MA) specimens MK3, MK4, MK5, MK6, and MK6-FAST was measured.

The microhardness was determined according to the Vickers method using a microscope of the company Carl Zeiss Microscopy GmbH (Model Axiophod 2), in which a hardness tester of the company Anton Paar GmbH (Model MHT-10) was integrated:

testing force: 10 p
testing time: 10 s
rate of rise: 15 p/s

The specimens were prepared as for the SEM analysis (see B. 2), but without gold sputtering.

50 indentations per phase were applied and analyzed.

The result is shown in FIG. 3 taking into consideration the standard deviation. The microhardness of the silicides in the FAST specimen is significantly higher than that in the mixed crystal phase. The very fine and homogeneous distribution of the silicide phases as well as their proportion of approximately 55% ensures a high overall hardness of the alloy. The overall hardness of the FAST specimen is composed of the respective microhardnesses of the individual phases, namely, the MoV mixed crystal phase and the two silicide phases.

The invention claimed is:

1. A molybdenum alloy with 5 to 25 at % silicon, 0.5 to 25 at % boron, and 20 to 40 at % vanadium as well as the remainder of molybdenum, wherein the proportion of molybdenum is at least 40 at %, wherein the molybdenum alloy has a molybdenum-vanadium mixed crystal matrix and at least one silicide phase distributed therein, and the density of the molybdenum alloy is less than 8 g/cm$^3$, and wherein at least one silicide phase is selected from $(Mo,V)_3Si$, $(Mo,V)_5SiB_2$, and $(Mo,V)_5Si_3$.

2. The molybdenum alloy according to claim 1, additionally containing titanium (Ti) in an amount of 0.5 to 30 at %.

3. The molybdenum alloy according to claim 2, wherein the content of Ti is 0.5 to 10 at %.

4. The molybdenum alloy according to claim 1, additionally containing one alloy element or a plurality of alloy elements selected from the group composed of Al, Fe, Zr, Mg, Li, Cr, Mn, Co, Ni, Cu, Zn, Ge, Ga, Y, Nb, Cd, Ca, and La, each in a content of 0.01 at % to 15 at %, and/or one alloy element or a plurality of alloy elements selected from the group composed of Hf, Pb, Bi, Ru, Rh, Pd, Ag, Au, Ta, W, Re, Os, Ir, and Pt, each in a content of 0.01 at % to 5 at %.

5. The molybdenum alloy according to claim 1, wherein the proportion of silicide phases is at least 30 at %.

6. The molybdenum alloy according to claim 1, wherein the alloy has a structure with a Mo—V mixed crystal matrix and $(Mo, V)_3Si$ and/or $(Mo,V)_5SiB_2$ distributed therein.

7. The molybdenum alloy according to claim 6, wherein the phase $(Mo,V)_5Si_3$ is additionally present.

8. The molybdenum alloy according to claim 2, additionally containing one alloy element or a plurality of alloy elements selected from the group composed of Al, Fe, Zr, Mg, Li, Cr, Mn, Co, Ni, Cu, Zn, Ge, Ga, Y, Nb, Cd, Ca, and La, each in a content of 0.01 at % to 15 at %, and/or one alloy element or a plurality of alloy elements selected from the group composed of Hf, Pb, Bi, Ru, Rh, Pd, Ag, Au, Ta, W, Re, Os, Ir, and Pt, each in a content of 0.01 at % to 5 at %.

9. The molybdenum alloy according to claim 3, additionally containing one alloy element or a plurality of alloy elements selected from the group composed of Al, Fe, Zr, Mg, Li, Cr, Mn, Co, Ni, Cu, Zn, Ge, Ga, Y, Nb, Cd, Ca, and La, each in a content of 0.01 at % to 15 at %, and/or one alloy element or a plurality of alloy elements selected from the group composed of Hf, Pb, Bi, Ru, Rh, Pd, Ag, Au, Ta, W, Re, Os, Ir, and Pt, each in a content of 0.01 at % to 5 at %.

10. The molybdenum alloy according to claim 2, wherein the proportion of silicide phases is at least 30 at %.

11. The molybdenum alloy according to claim 3, wherein the proportion of silicide phases is at least 30 at %.

12. The molybdenum alloy according to claim 4, wherein the proportion of silicide phases is at least 30 at %.

13. The molybdenum alloy according to claim 6, wherein the proportion of silicide phases is at least 30 at %.

14. The molybdenum alloy according to claim 7, wherein the proportion of silicide phases is at least 30 at %.

15. The molybdenum alloy according to claim 8, wherein the proportion of silicide phases is at least 30 at%.

16. The molybdenum alloy according to claim 9, wherein the proportion of silicide phases is at least 30 at %.

* * * * *